US009482479B1

(12) United States Patent
Jen

(10) Patent No.: US 9,482,479 B1
(45) Date of Patent: Nov. 1, 2016

(54) AMBIDEXTROUS LATCHLESS CHARGING HANDLE WITH GAS REDIRECTION

(71) Applicant: Yi Huei Jen, Irvine, CA (US)

(72) Inventor: Yi Huei Jen, Irvine, CA (US)

( * ) Notice: Subject to any disclaimer, the term of this patent is extended or adjusted under 35 U.S.C. 154(b) by 0 days.

(21) Appl. No.: 14/737,220

(22) Filed: Jun. 11, 2015

(51) Int. Cl.
*F41A 3/72* (2006.01)
*F41A 35/06* (2006.01)

(52) U.S. Cl.
CPC . *F41A 3/72* (2013.01); *F41A 35/06* (2013.01)

(58) Field of Classification Search
CPC ..... F41A 3/72; F41A 35/06
USPC ..... 89/1.4, 1.42; 42/43, 69.02
See application file for complete search history.

(56) References Cited

U.S. PATENT DOCUMENTS 7,798,045 B1 * 9/2010 Fitzpatrick ..... F41A 21/481 42/69.02
8,381,628 B1 * 2/2013 Wheatley ..... F41A 3/72 42/43
9,175,913 B2 * 11/2015 Cupps ..... F41A 3/72
2011/0271827 A1 * 11/2011 Larson ..... F41A 5/28 89/193
2013/0092014 A1 * 4/2013 Kincel ..... F41A 3/72 89/1.4

* cited by examiner

*Primary Examiner* — John D Cooper
(74) *Attorney, Agent, or Firm* — Che-Yang Chen; Law Offices of Scott Warmuth

(57) ABSTRACT

A charging handle for a firearm having a receiver has an elongated rod running from a front end to a rear end at which a crossbar portion is connected to the rod. The crossbar portion is laterally situated to each side of the elongated rod and features redirection channels on both the top and bottom surfaces and is sized, shaped, and adapted to be gripped by a shooter using the firearm. The charging handle has flexible tabs on either side of the elongated rod for securement of the charging handle within groove on the firearm receiver. Rearward force by a user on either the left, right, or both sides of the crossbar portion user disengages the tabs from the grooves and releases the charging handle thereby allowing the charging handle to freely move along the firearm receiver.

12 Claims, 3 Drawing Sheets

AMBIDEXTROUS LATCHLESS CHARGING HANDLE WITH GAS REDIRECTION

BACKGROUND

Typically, the military M-16 rifle and its civilian variants have a T-shaped charging handle that is operable by a user to retract and lock the bolt to the rear of the rifle or to clear a weapons malfunction. In turn, this allows the charging handle to engage the bolt assembly of the rifle and loads a cartridge into the chamber. The T-shaped design means that the charging handle is an elongated body with a crossbar at its rear end. Hence, a user can operate the charging handle by engaging the crossbar section with a hand or with fingers and then pulling the charging handle to the rear. When released, the forward end of the charging handle then engages the rifle's bolt assembly.

The charging handle utilizes a latch typically situated on either side of the elongated body section, and attached to the crossbar section. This latch is typically a spring-loaded L-shaped single piece with a hook on one end, and a paddle on the other end. This latch prevents inadvertent rearward movement of the charging handle by engagement of the hook and a latch pocket situated on the upper receiver of the rifle. Hence, a user can engage the paddle with a hand or finger and release the charging handle for operation. This is where the issues with charging handle latches lie. The first issue is the incompatibility of charging handles to be utilized by both right and left hand shooters, as the latch is typically located on one side of the crossbar section. U.S. Pat. No. 8,336,436 "Ambidextrous cam style charging handle" provides one of the recognized methods to eliminate left and right hand utilization incompatibility. These designs provide a means for a user to operate the charging handle with either their left or right hand.

Unfortunately, this arrangement still features a hooked latch as the release mechanism. The latch rotates about the vertical axis of the rifle relative to the firing direction of the rifle. This rotation in combination with the spring tension means that the latch is naturally at rest when the spring is neither in tension nor in compression. Hence, addition of tension to the spring means that the latch is in an unnatural position and wants to be returned to rest. Hence, operation of the charging handle causes wear to the latch pocket in which it rests when not in operation. This wear is not only unpleasant for the look of the rifle, but also detrimental to the long term use of the charging handle latch pocket.

Additionally, once the charging handle is "charged", a cartridge is loaded into the bolt assembly. Once this cartridge is fired, the cartridge produces gas pressure which is used to load a subsequent cartridge into the bolt assembly. Unfortunately, a portion of the gas is also discharged along the bottom and the top surfaces of the charging handle which in turn impacts a shooter's eyes and face. This is undesirable and is dangerous as unused gun powder and residue can also be transported by the gas pressure and into the face and eyes of the shooter.

As with the case for the latchless designs, gas redirection designs which divert gases away from the face of the shooter have been utilized, but prove to have minimal effect in redirecting sufficient enough gases away from the shooter. Furthermore, these prior designs only focus on the gases and residue carried along the top surface of the charging handle but neglect to address the gases carried along the bottom surface of the charging handle It is therefore desirable to provide an improved charging handle which is not only ambidextrous, but also does not feature a latch which will deteriorate the latch pocket, and will redirect residual gases carried along both the top and bottom surface of the charging handle.

SUMMARY

The invention relates to a firearm charging handle for loading a firearm with a bullet and specifically to a charging handle that is ambidextrously operable as well as protects a shooter from excess gases travelling towards a shooters eyes and face. In the preferred embodiments, a top gas redirection channel is used to direct excess gases travelling along the top surface of the charging handle, a bottom gas redirection channel is used to direct excess gases traveling along the bottom surface of the charging handle, and flexible tabs are used to provide a latchless mechanism for securing the charging handle within the receiver of a firearm.

The invention consist of an elongated rod with a front end and a rear end, where the rear end features a handle portion by which a user can ambidextrously engage the invention with a hand or a finger via engagement surfaces. Each engagement surface is situated to the left and right of the elongated rod and is generally perpendicular to the elongated rod.

The top surface of the rear end features a wall which is generally semi-circular in shape and further features the top gas redirection channel within the wall. As excess gases travel along the top surface, the gases impact the rear wall and flows into the top gas redirection channel which is also semicircular and designed to disperse the gas away from the shooter in a forward and lateral direction. Thereby providing protection to a shooter from excess gases traveling along the top surface.

The bottom surface of the rear end features a generally rectangular shaped surface and further features a bottom gas redirection channel within the bottom surface. As the excess gases travel along the bottom surface towards the shooter, the gases enter the bottom gas redirection channel, which is generally, "T" shaped, and dissipates forwards and laterally away from the shooter. Thereby providing protection to a shooter from excess gases traveling along the bottom surface.

The flexible tabs are features on the elongated rod between the front end and the rear end, and provides a means for securing the charging handle in position within the firearm receiver. The flexible tabs are sufficiently flexible and bend, similar to a pinching action, which allows the tabs to flex inward when pushed into a receiver (closed position) or retracted from the receiver (open position). This action is possible due to grooves located within the firearm receiver which lock the tabs in place via a ridged position on the flexible tab. The ridged portion which protrudes from the flexible tabs sufficiently enough to allow easy operation without any latch, ball bearing, or detent. The flexible tab is connected to the elongated rod at a single point of attachment on the side surfaces of the elongated rod. Engagement of either engagement surface at the rear end of the invention will provide a force which bends the flexible tab such that the invention can be slidably operable within the receiver.

It is an object of the invention to provide a firearm charging handle that requires no modification of the firearm for its use.

The invention and all its embodiments will be apparent for a charging handle for a firearm having a receiver and having a generally elongated rod having a top surface, side surfaces, and a bottom surface; a front end and a rear end, said rear end having at least a portion thereof adapted to extend outside of said receiver and being shaped, sized, and adapted to be gripped at an engagement surface by a hand or a finger of a shooter wherein said rear portion comprises: a top channel on the top surface at the rear end of the charging handle and a bottom channel on the bottom surface of the rear end of the charging handle for redirecting gases traveling along the top and bottom surfaces away from the firearm; and at least one flexible tab located between the top and bottom surfaces, on the side surface, wherein said flexible tab is adapted to flex inward such that the elongated rod is slidably movable within a firearm receiver, wherein the charging handle engages the receiver through the flexible tab.

DESCRIPTION OF DRAWINGS

The following descriptions are set forth and have been assigned numerical designations to enable the reader to understand the reasoning behind and the application of the present invention. While the preferred embodiment of the present invention is aimed at an ambidextrous latchless charging handle with a top and bottom gas channel, showing an AR receiver, the invention is applicable to other firearms featuring a means to utilize a charging handle.

DETAILED DESCRIPTION OF DRAWINGS

Figure 1:
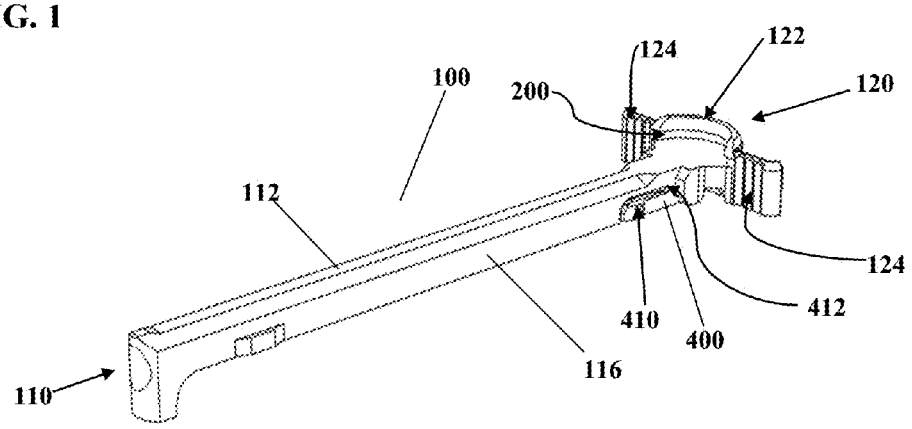
FIG. 1 is an illustration of the present invention.

FIG. 1 is an illustration of the present invention 100. The front end 110 is the beginning of the elongated rod portion of the charging handle 100 which features a top surface 112 and side surfaces 116, and runs to a rear end 120 at which a rear wall 122 is situated.

The rear end 120 features flexible tabs 400 which at attached to the side surface 116 at a single point of attachment 412. The flexible tab 400 further comprises a raised ridged portion 410. The aforementioned rear wall 122 features a semi-circular top channel 200 by which gas traveling along the top surface 112 of the charging handle 100 can be dissipated away from the rear end portion 120. The rear end portion 120 further comprises engagement surfaces 124 that allow a user to engage the charging handle for insertion or extraction from a firearm.

Figure 2:
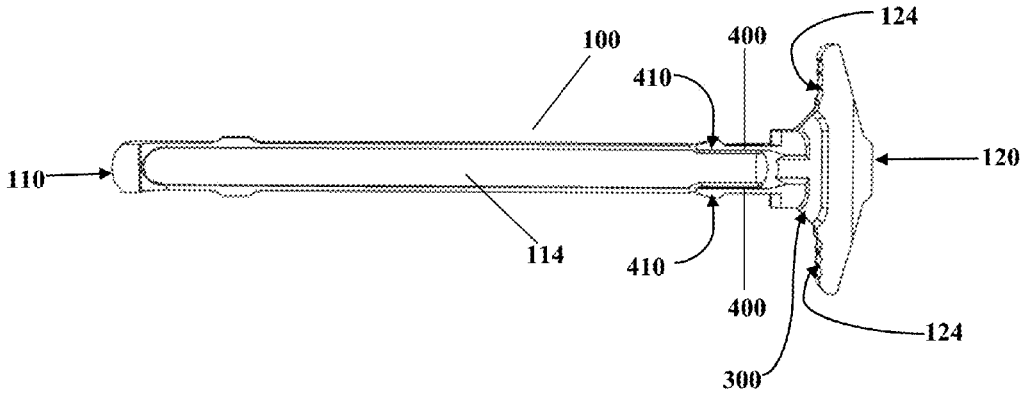
FIG. 2 is a bottom view illustration of the present invention.

FIG. 2 is a bottom view illustration of the present invention 100 showing the bottom surface 114 and the "T" shaped bottom channel 300 which dissipates gas traveling along the bottom surface 114 away from the rear end 120. Similarly to FIG. 1, the flexible tabs 400 is also shown as is the raised ridged portion. It should be noted that the position of the tabs 400, as shown, parallel to the side surface 116 is considered the normal, unbent position of the flexible tabs 400.

Figure 3:
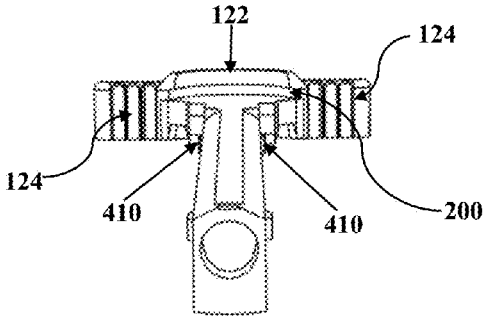
FIG. 3 is a front view illustration of the present invention.

FIG. 3 is a front view illustration of the present invention 100 showing the engagement surfaces 124 by which a user can engage the charging handle 100. This figure specifically shows the raised ridges 410 which protrude out of the flexible tab 400 as well as the relative height of the rear wall 122.

Figure 4:
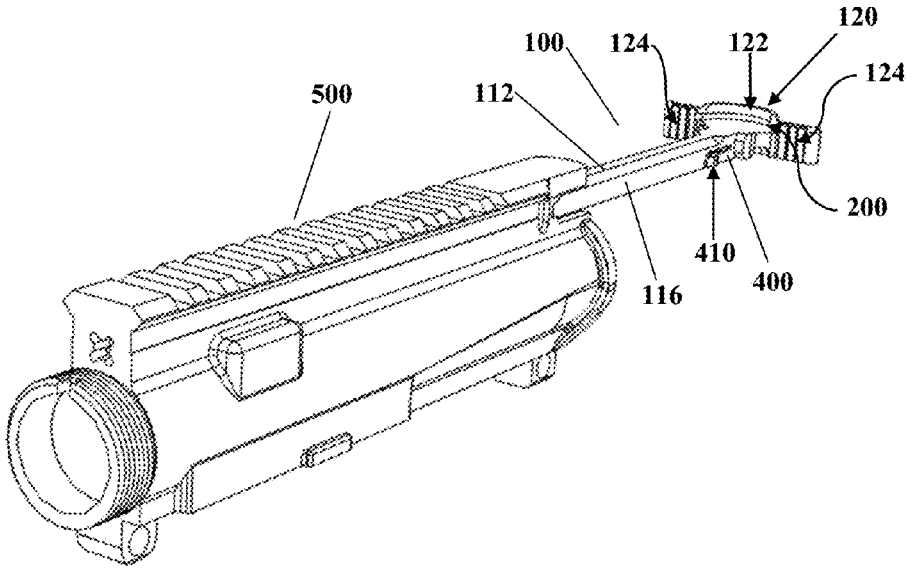
FIG. 4 is an illustration of the present invention partially inserted into a firearm receiver.
Figure 5:
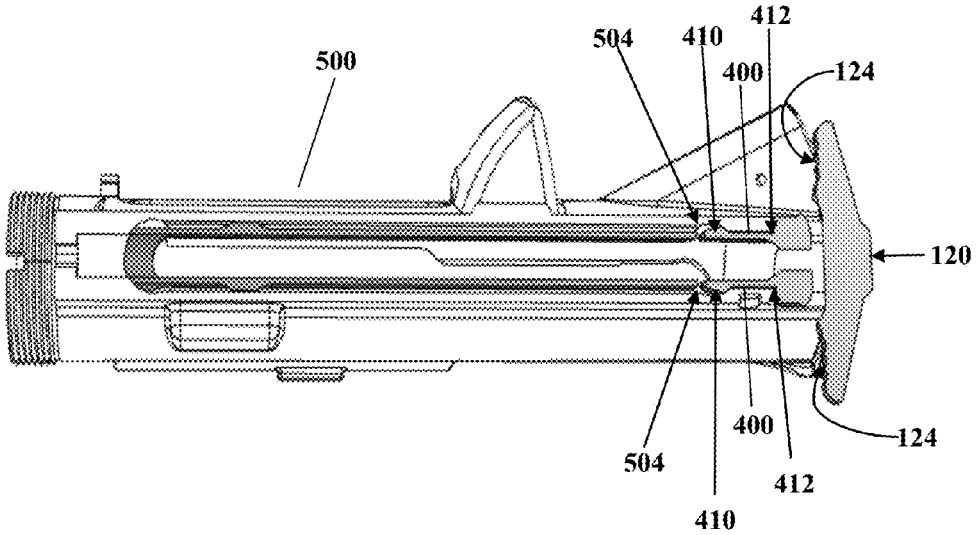
FIG. 5 is a top cross section view illustration of the present invention fully inserted into a firearm receiver.

FIG. 4 is an illustration of the charging handle 100 prior to full insertion into a firearm receiver 500. Through engagement of the rear end 120, a shooter can slidably push the charging handle into the firearm receiver 500 whereby side surface 116, top surface 112, and flexible tab 400 will be fully enclosed within the firearm receiver 500. As the charging handle 100 is inserted into the receiver 500, the flexible tabs 400 will bend towards each other, in a pinching motion, and allow the charging handle to slide into the receiver. FIG. 5 which is a cross sectional top view of the present invention 100 inserted into a firearm receiver 500 is an ideal illustration of the present invention in use.

When the charging handle 100 is fully inserted into a firearm receiver 500, the point of attachment 412 of the flexible tabs 400 will ideally be completely enclosed by the firearm receiver which means the rear wall 122 will rest against the receiver 500.

At this point, the flexible tabs 400 will return to its normal, unbent, position due to grooves 504 included in a majority of firearm receivers 500. This normal position combined with the grooves 504 provide a surface by which the ridged portion 410 on the flexible tab 400 can engage the receiver 500 and remain in place till a rearward force is applied by a user on the engagement surface 124.

Figure 6:
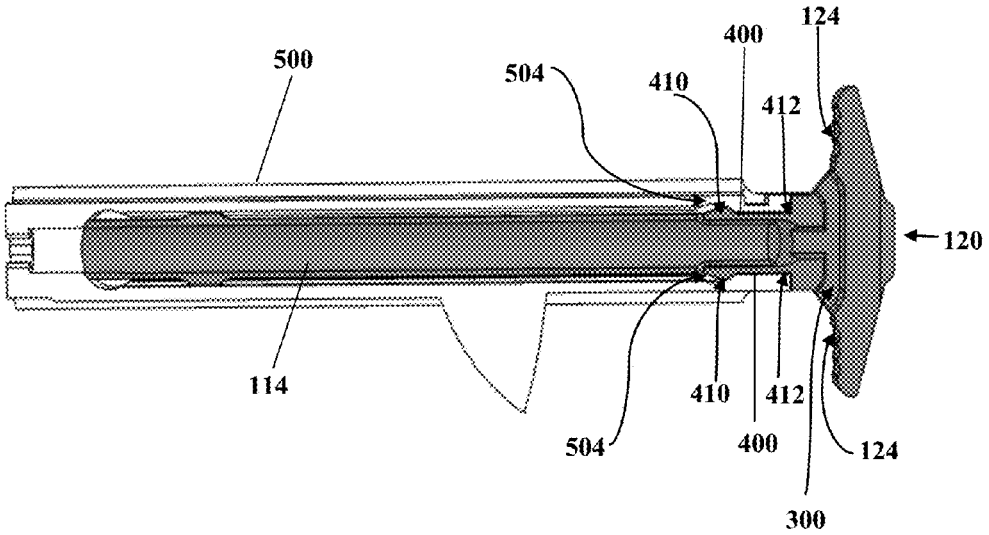
FIG. 6 is a bottom cross section view of the present invention fully inserted into a firearm receiver.

Due to the fact that the rear wall 122 rests against the receiver 500, any excess gas sent along the top surface 112 (shown in FIG. 4) will impact the rear wall 122 (shown in FIG. 4), but more specifically the semi-circular top channel 200 (shown in FIG. 4). FIG. 6 shows a cross sectional bottom view of the present invention 100 fully inserted into a firearm receiver 500 with the flexible tabs 400 in a normal position and resting in the receiver grooves 504 via ridged portion 410. Similarly to FIG. 5, any gas traveling along the bottom surface 114 will travel along the elongated rod till it impacts the bottom channel 300, at which point the gas will dissipate laterally away from the rear end 120 and ultimately the shooter located behind that rear end.

Figure 7:
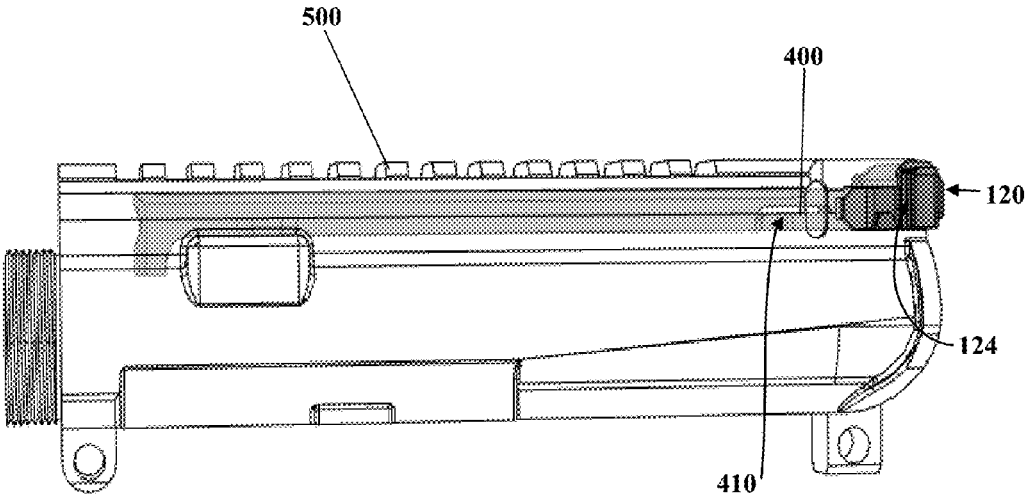
FIG. 7 is a side view of the present invention inserted into a firearm receiver with transparent outer surfaces.

FIG. 7 is a side view of the present invention 100 inserted into a firearm receiver 500, with transparent outer surfaces, showing the engagement surface 124 at the rear end 120 as the only portions of the charging handle 100 left exposed when the charring handle 100 is in a closed position.

The invention claimed is:

1. A charging handle for a firearm having a receiver, said charging handle comprising: a generally elongated rod having a top surface, side surfaces, and a bottom surface; a front end and a rear end, said rear end having at least a portion thereof adapted to extend outside of said receiver and being shaped, sized, and adapted to be gripped at an engagement surface by a hand or a finger of a shooter wherein said rear portion comprises: a top channel on the top surface at the rear end of the charging handle and a bottom channel on the bottom surface of the rear end of the charging handle for redirecting gases traveling along the top and bottom surfaces away from the firearm; and at least one flexible tab located between the top and bottom surfaces, on the side surface, wherein said flexible tab is adapted to flex inward such that the elongated rod is slidably movable within a firearm receiver, wherein the charging handle engages the receiver through the flexible tab.

2. The charging handle of claim 1, wherein the top surface at the rear end portion of the charging handle has a curved wall.

3. The charging handle of claim 2, wherein the curved wall forms a semi-circle.

4. The charging handle of claim 3, wherein the top channel forms a semi-circle.

5. The charging handle of claim 2, wherein the top channel extends across the entirety of the curved wall.

6. The charging handle of claim 1, wherein the bottom surface of the rear end portion is rectangular shaped.

7. The charging handle of claim 1, wherein the bottom channel is "T" shaped.

8. The charging handle of claim 1, wherein the flexible tab comprises at least a ridged portion which engages the receiver through bending the tab about a point of attachment of the tab on the side surface of the elongated rod.

9. The charging handle of claim 8, wherein the flexible tab is unstressed prior to insertion into a receiver and is under elastic strain upon insertion into a receiver, but locks the charging handle in a closed position once the point of attachment is completely inserted into the firearm receiver.

10. The charging handle of claim 9, wherein the flexible tab has a flexural modulus sufficient enough to allow inward bending and a return to a normal position.

11. The charging handle of claim 10, wherein the normal position of the flexible tab is unbent and parallel relative to the side surface.

12. The charging handle of claim 1, wherein engagement of the engagement surface by a shooter bends the flexible tab and allows movement of the charging handle from an open to close position, or vice versa.

* * * * *